US006037855A

United States Patent [19]

Honma

[11] Patent Number: 6,037,855

[45] Date of Patent: Mar. 14, 2000

[54] ROTARY ELECTRIC COMPONENT HAVING A GROOVE FOR ADJUSTMENT WITH SCREW-DRIVER

[75] Inventor: Toshio Honma, Miyagi-ken, Japan

[73] Assignee: Alps Electric Co., Ltd., Tokyo, Japan

[21] Appl. No.: 09/255,070

[22] Filed: Feb. 22, 1999

[30] Foreign Application Priority Data

Feb. 24, 1998 [JP] Japan ..... 10-041629
Feb. 24, 1998 [JP] Japan ..... 10-041630

[51] Int. Cl.[7] ..... H01C 10/30

[52] U.S. Cl. ..... 338/160; 338/162; 338/184; 338/199

[58] Field of Search ..... 338/160, 162, 338/163, 164, 167, 170, 184, 199

[56] References Cited

U.S. PATENT DOCUMENTS 4,052,786 10/1977 Hufford et al. .
4,114,131 9/1978 Nakatsu et al. .
4,427,966 1/1984 Gratzinger et al. ..... 338/162
4,521,761 6/1985 Welch ..... 338/174
4,626,823 12/1986 Smith ..... 338/199
4,914,417 4/1990 Matsui et al. ..... 338/174
5,525,956 6/1996 Hashizume et al. ..... 338/322
5,592,141 1/1997 Castellano Aldave ..... 338/162

FOREIGN PATENT DOCUMENTS 50-18949 6/1973 Japan .

*Primary Examiner*—Michael L. Gellner
*Assistant Examiner*—Richard K. Lee
*Attorney, Agent, or Firm*—Brinks Hofer Gilson & Lione

[57] ABSTRACT

The present invention is concerned with a rotary electric component having a groove for adjustment with a screw-driver. In the rotary electric component, a rotor having a screw-driver groove and a through hole, with an electrically conductive pattern being formed on the underside thereof, is mounted rotatably on a support shaft which is inserted into the through hole.

18 Claims, 9 Drawing Sheets

ROTARY ELECTRIC COMPONENT HAVING A GROOVE FOR ADJUSTMENT WITH SCREW-DRIVER

BACKGROUND OF THE INVENTION

1. Field of the Invention

The present invention relates to a rotary electric component having a groove for adjustment with a screw-driver which is suitable for use, particularly, in a pre-set trimmer potentiometer.

2. Description of the Related Art

In a conventional rotary electric component such as a trimmer potentiometer, as shown in FIG. 15, a contact piece 232, a support shaft 233, a terminal 234 mounted by the support shaft 233, and a metallic cover 235, are mounted to an insulating substrate 231 which is formed of a synthetic resin.

Further, a rotor 236 formed of a synthetic resin has a shaft portion 236*a* and a circular base portion 236*c* with a recess 236*b* formed therein. On the underside of the base portion 236*c* are formed a resistor 237 and a good conductor 238.

In constituting the rotor 236, the support shaft 233 is fitted into the recess 236*b*, the shaft portion 236*a* is projected from a hole 235*a* of the cover 235, and a plate spring 239 is disposed between the base portion 236*c* and the cover 235.

The rotor 236 when installed is held rotatably by both the support shaft 233 and the cover 235, and the contact piece 232 comes into contact with the resistor 237. Further, the rotor 236 is pushed by the plate spring 239 and the good conductor 238 is in contact with the support shaft 233.

In such a rotary electric component, as the shaft portion 236*a* of the rotor 236 is rotated, the rotor 236 rotates while being guided by both support shaft 233 and cover 235. At the same time, with the good conductor 238 in contact with the support shaft 233, the resistor 237 slides on the contact piece 232 to adjust the resistance value.

SUMMARY OF THE INVENTION

The conventional rotary electric component requires the support shaft 233, the cover 235 and the plate spring 239 for holding the rotor 236, thus resulting in an increase in the number of parts used giving rise to the problem that the rotary electric component is large-sized, high in cost and poor in productivity.

Moreover, the use of the cover 235 and the plate spring 239 involves the problem that it is difficult to automate the assembling work.

Further, since the rotor 236 is formed of a synthetic resin, it warps due to heat or secular change, which warp exerts an adverse effect on the resistor 237 and good conductor 238 both disposed on the underside of the rotor, with the result that an electric component of high accuracy is not obtained.

According to the present invention, in order to solve the above-mentioned problems, there is provided a rotary electric component comprising a rotor having a screw-driver groove formed in the top surface thereof and a central through hole; an electrically conductive pattern formed on the underside of the rotor; a support shaft inserted into the through hole of the rotor to support the rotor rotatably; and a support member for supporting the support shaft and a slider piece which is in sliding contact with the electrically conductive pattern.

The rotor may be mounted onto the support shaft by caulking a front end portion of the support shaft to the bottom of the screw-driver groove.

The rotor may be mounted onto the support shaft by attaching a speed nut to the front end portion of the support shaft and bringing the support nut into abutment against the bottom of the screw-driver groove.

The rotor may be formed using a ceramic material.

The outer peripheral portion of an upper surface of the rotor may be formed as a flat surface.

The support member may be formed using an insulating material, the electrically conductive pattern may be formed of both a good conductor and a resistor, and the support shaft and the slider piece may be embedded in the support member.

The support member may be provided with a bottom portion for holding the support shaft, an extending portion having a flat upper surface may be formed by extension from the bottom portion up to near the support shaft, the flat surface may be brought into abutment against the underside of the rotor, and the slider piece maybe disposed in a cavity where the extending portion is not formed. Further, the support member may be formed in a box shape so that the extending portion, the support shaft and the slider piece are positioned in the interior of the box, and the side wall upper surface of the support member may be formed as a flat surface and brought into abutment against the underside of the rotor.

BRIEF DESCRIPTION OF THE DRAWINGS

Rotary electric components such as, for example, preset type trimmer potentiometers, embodying the present invention will be described below with reference to the accompanying drawings.

FIGS. 1 to 5 illustrate a rotary electric component according to the first embodiment of the present invention, of which:

FIG. 1 is a plan view of the rotary electric component;

FIG. 2 is a side view thereof;

FIG. 3 is a sectional view thereof;

FIGS. 4A and 4B are diagrams showing a support member of the rotary electric component, in which FIG. 4A is a bottom view and FIG. 4B is a plan view.

FIGS. 6 to 14 illustrate a rotary electric component according to the second embodiment of the present invention, of which:

FIG. 6 is a plan view thereof;

FIG. 7 is a side view thereof;

FIG. 8 is a sectional view taken on line 8—8 in FIG. 6;

FIG. 9 is a sectional view taken on line 9—9 in FIG. 6;

FIG. 10 is a plan view of a support member;

FIG. 11 is an explanatory diagram showing in what manner contact members are mounted to the support member;

FIG. 12 is an explanatory diagram showing in what manner the contact members are mounted to terminal portions;

FIG. 13 is a plan view of a rotor; and

FIG. 14 is a bottom view thereof.

DESCRIPTION OF THE PREFERRED EMBODIMENTS

A trimmer potentiometer as a rotary electric component according to the first embodiment of the present invention will now be described with reference to FIGS. 1 to 5. A support member 1 formed of an insulating synthetic resin has a central recess 1*a* and a stopper portion 1*b* formed at a part of its outer periphery. In the support member 1 are integrally embedded a support shaft 2 formed of a metallic plate and a pair of contact members 3 and 4 each formed of a resilient metallic plate.

The support shaft 2, which is formed by drawing, comprises a shaft portion 2*d* and a terminal portion 2*e*, the shaft portion 2*d* comprising a large-diameter portion 2*a*, a small-diameter portion 2*b* and a shoulder portion 2*c* formed between the large and small-diameter portions.

The paired contact members 3 and 4 respectively comprise base portions 3*a*, 4*a*, contact portions 3*b*, 4*b* extending from one ends of the base portions 3*a*, 4*a*, and terminal portions 3*c*, 4*c* extending from the opposite ends of the base portions 3*a*, 4*a*.

Figure 5A:
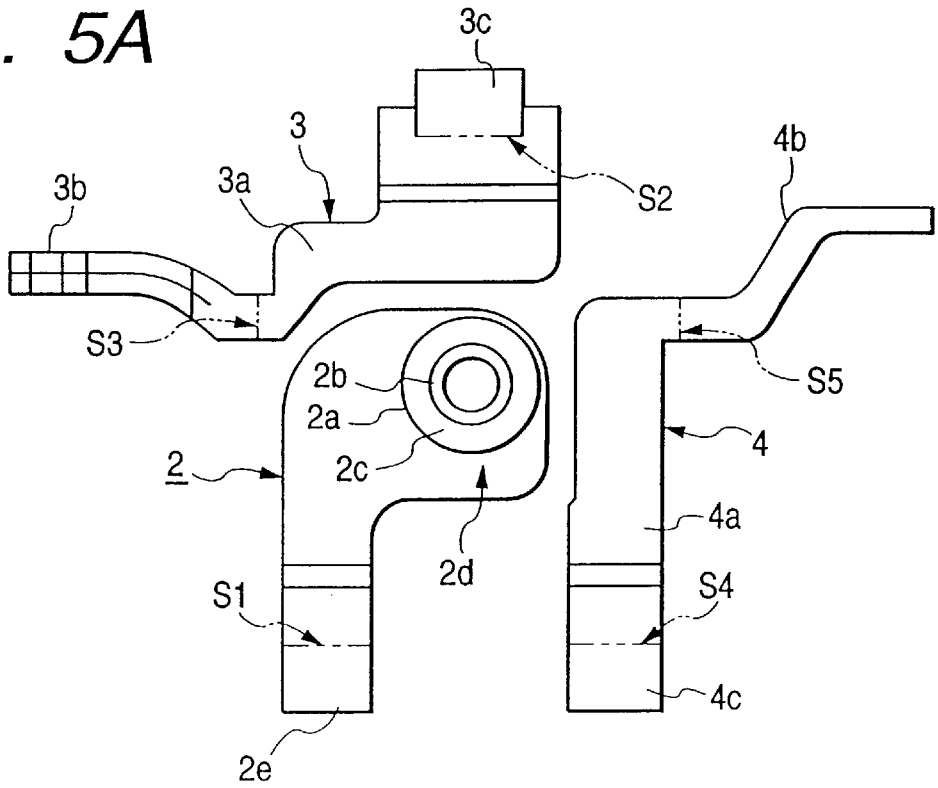
FIGS. 5A and 5B are explanatory diagrams showing how to manufacture the rotary electric component.
Figure 5B:
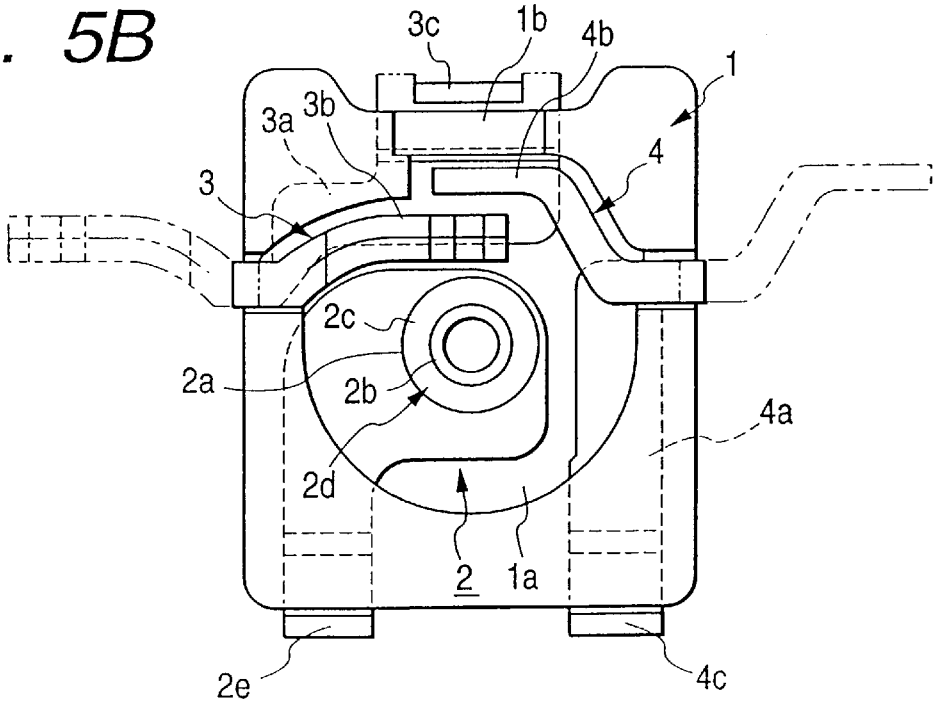
Figure 6:
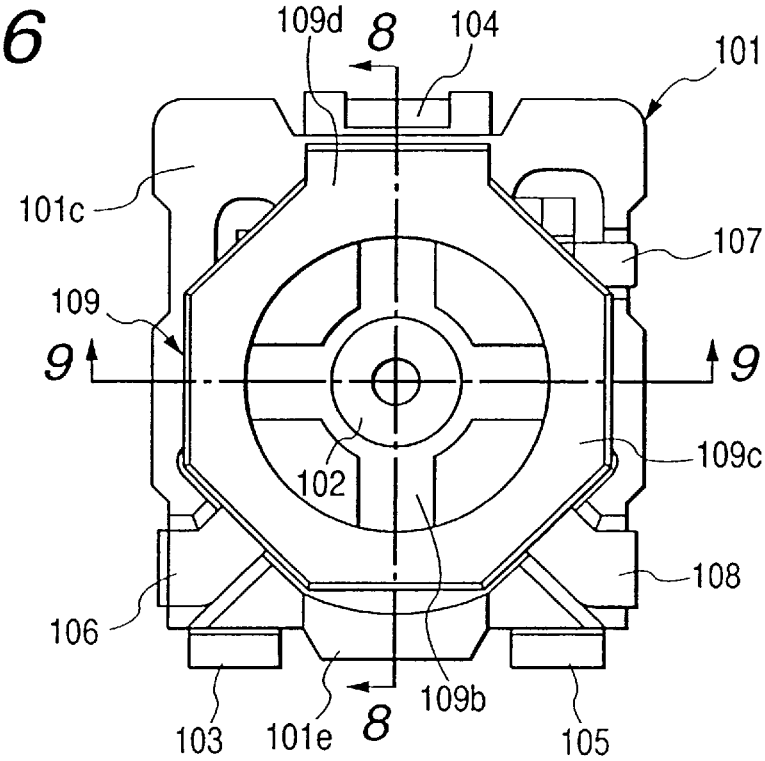
Figure 7:
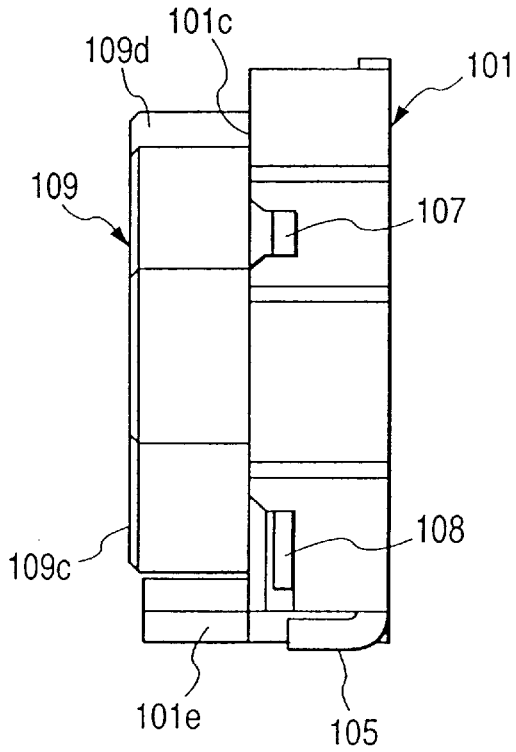
Figure 8:
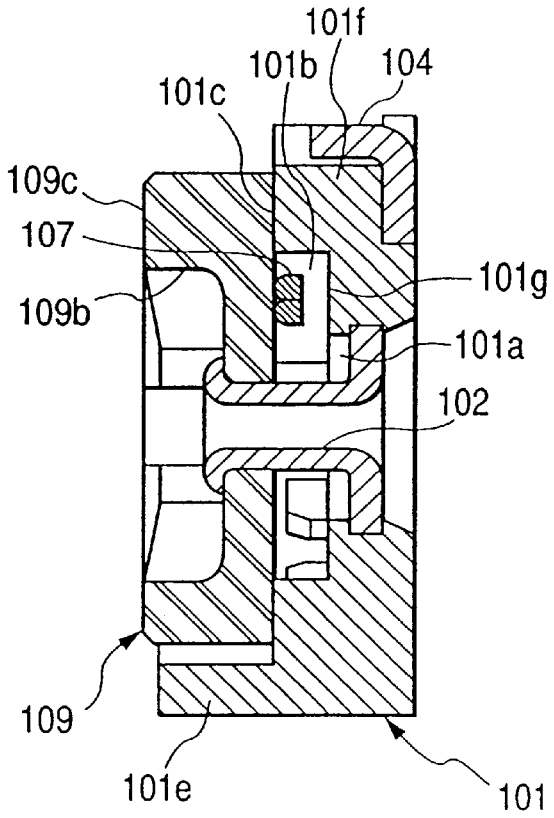
Figure 9:
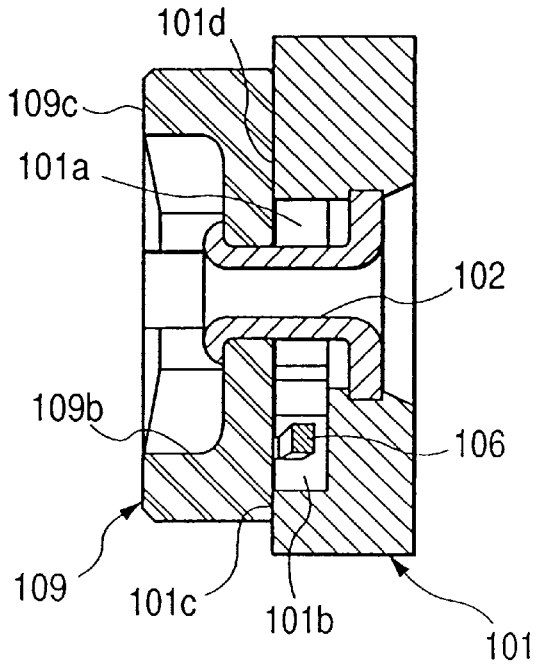

The support shaft 2 and the paired contact members 3, 4 are mounted to the support member 1 in the following manner. The support shaft 2 and the contact members 3, 4 are arranged in such a state as shown in FIG. 5A and thereafter, as shown in FIG. 5B, the support member 1 is formed by molding of a synthetic resin so that the support shaft 2 and the contact members 3, 4 are embedded in the support member 1.

Subsequently, the support shaft 2 is bent at right angles along line S1 in FIG. 5A, the contact member 3 is bent at right angles along line S2 and bent at 180° along line S3, allowing the contact portion 3*b* to be positioned within the recess 1*a* of the support member 1, and the contact member 4 is bent at right angles along line S4 and bent at 180° along line S5, allowing the contact portion 4*b* to be positioned within the recess 1*a* of the support member 1. In this way the rotary electric component is manufactured.

A rotor 5, which is formed in an octagonal shape using a ceramic material, has a central through hole 5*a*, a crossed screw-driver groove 5*b* formed in an upper surface of the rotor, a flat surface 5*c* formed as part of the upper surface so as to surround the outer peripheral portion of the crossed screw-driver groove 5*b*, and a stopper portion 5*d* formed at a side position.

Figure 1:
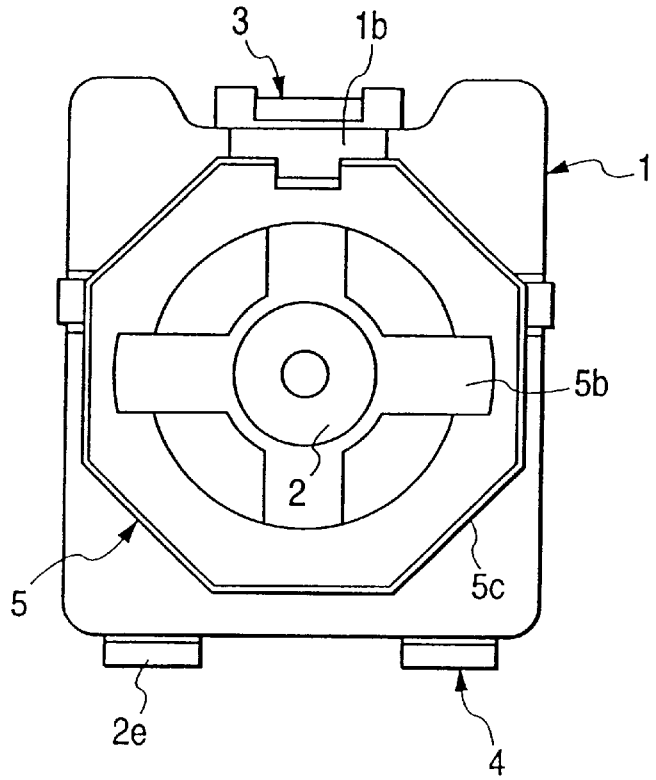
Figure 2:
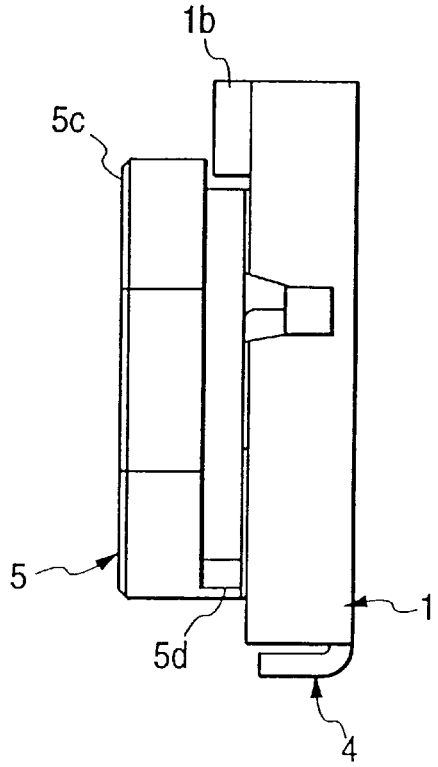
Figure 3:
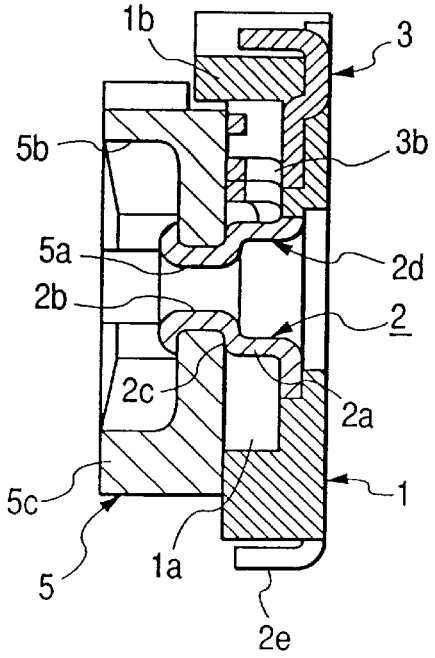
Figure 4A:
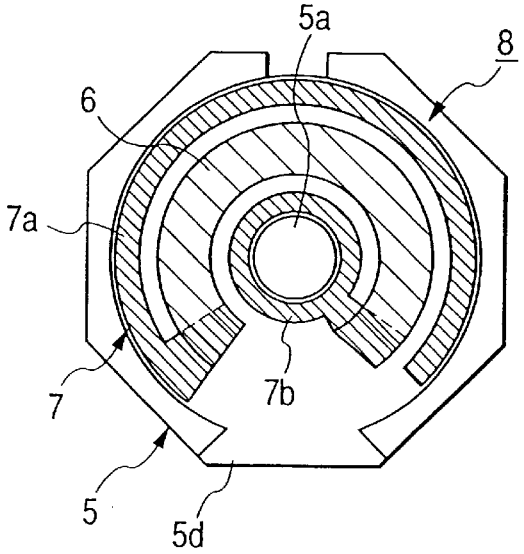
Figure 4B:
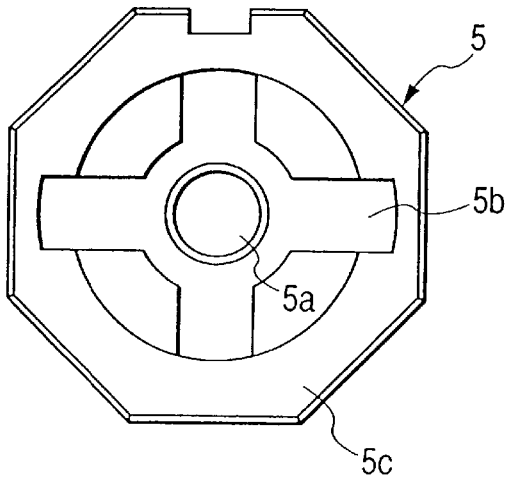

On the underside of the rotor 5 is formed an electrically conductive pattern 8 which comprises a resistor 6 and a good conductor 7 such as silver, as shown in FIG. 4.

The good conductor 7 comprises a good conductor 7*a* formed outside the resistor 6 and a good conductor 7*b* formed inside the resistor. The outside good conductor 7*a* is connected to one end of the resistor 6, while the inside good conductor 7*b* is connected to the opposite end of the resistor 6 and is formed in electric conduction with both interior and periphery of the through hole 5*a*.

The small-diameter portion 2*b* of the support shaft 2 is inserted through the through hole 5*a* of the rotor 5 and its front end is caulked to the periphery of the through hole 5*a* at the bottom of the screw-driver groove 5*d*. In this way the rotor 5 is mounted onto the support shaft 2.

Since the rotor 5 is held at the bottom of the screw-driver groove 5*d*, it is possible to ensure a sufficiently large space for the insertion of a screw-driver therein. For this holding, scarcely any height is needed, because the front end of the small-diameter part 2*b* is caulked in this embodiment. This is suitable particularly for the reduction of thickness. Instead of caulking, a speed nut (not shown) maybe press-fitted in the small-diameter portion 2*b* to mount the rotor 5 onto the support shaft 2. Also in this case a large space for the insertion of a screw-driver can be ensured because the rotor 5 is held at the bottom of the screw-driver groove 5*d*.

In this mounted state of the rotor 5, the good conductor 7*b* is brought into pressure contact with the shoulder portion 2*c* of the support shaft 2 and the portion of the good conductor 7*b* formed within the through hole 5*a* comes into contact with the small-diameter portion 2*b*. Further, the contact portion 3*b* of the contact member 3 comes into contact with the resistor 6 and the contact portion 4*b* of the contact member 4 is in contact with the good conductor 7*a* located outside.

In this rotary electric component, when a screw-driver is fitted in the groove 5*b* of the rotor 5 and is turned to rotate the rotor 5, the outside good conductor 7*a* and the resistor 6 come into sliding contact with the contact members 4 and 3, respectively, while the inside good conductor 7*b* is in contact with the support shaft 2, to adjust the resistance value between the terminal portions 3*c* and 4*c* and the resistance value between the terminal portions 3*c* and 2*e*.

The rotation of the rotor 5 stops upon abutment of the stopper portion 5*d* of the rotor 5 against the stopper portion 1*b* of the support member 1.

In this rotary electric component, the rotor 5 is assembled by the steps of sucking the flat surface 5*c* of the rotor 5 by virtue of vacuum (not shown), moving the rotor 5 up to the support member 1, fitting the through hole 5*a* of the rotor 5 on the support shaft 2 mounted to the support member 1, and then caulking the front end portion of the support shaft 2. The assembly is now completed and thus can be effected automatically.

A trimmer potentiometer as a rotary electric component according to the second embodiment of the present invention will now be described with reference to FIGS. 6 to 14. As shown particularly in FIGS. 10 and 11, a support member 101 is formed of an insulating synthetic resin generally in a box shape having a side wall 101*f* and a bottom 101*g*. Further, the support member 101 is provided with a recess or hole 101*a* formed centrally in the bottom 101*g*, a plurality of cavities 101*b* formed on one side of the support member, an outer flat surface 101*c* formed on one side of the support member and on top of the side wall 101*f* and positioned between the cavities 101*b*, an extending flat surface 101*d* contiguous to the outer flat surface 101*c* and extending the hole 101*a*, and a stopper portion 101*e* formed at part he outer periphery of the support member.

A support shaft 102 formed of a metallic plate is embedded in the support member 101. A shaft portion of the support shaft 102 is positioned within the hole 101*a* of the support member 101 and is projected to one side of the support member 101.

Figure 10:
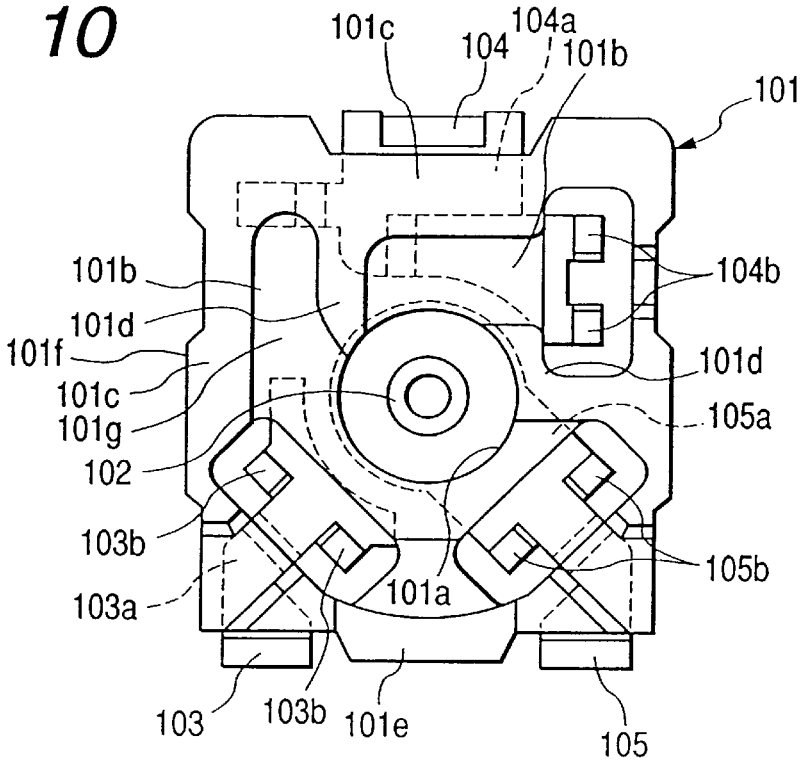
Figure 11:
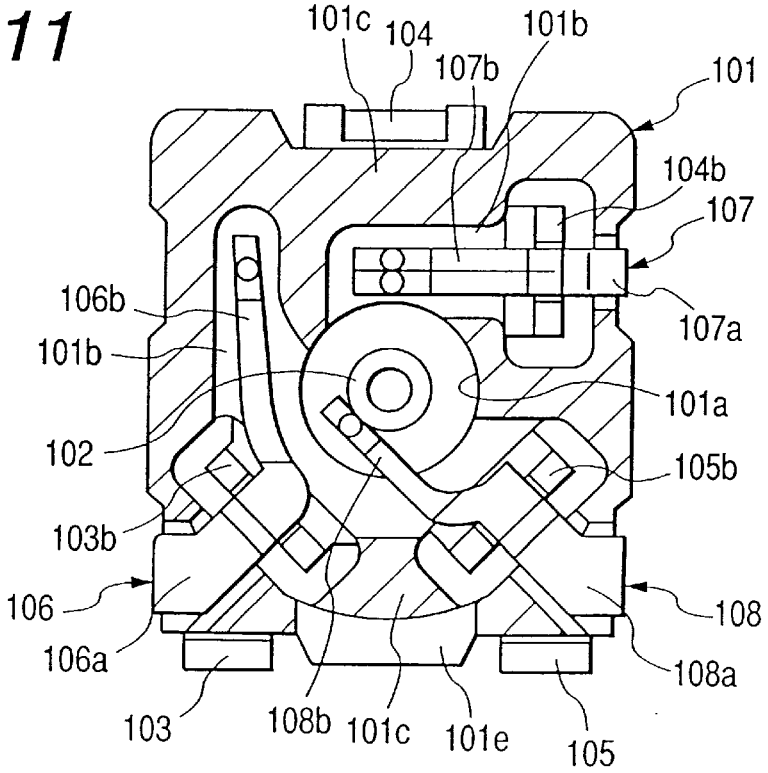
Figure 12:
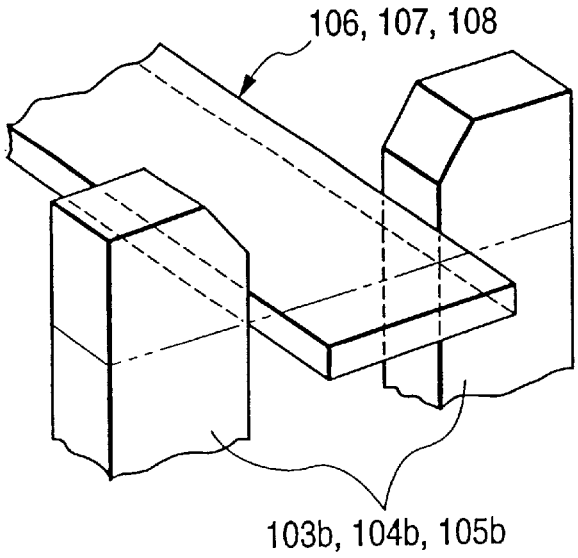

As shown in FIGS. 10 to 12, three terminal portions 103, 104 and 105 each formed of a relatively thick metallic plate are respectively provided with base portions 103*a*, 104*a* and 105*a* and U-shaped clamp portions 103*b*, 104*b* and 105*b* formed at one ends of the base portions 103*a*, 104*a* and 105*a*. The base portions 103*a*, 104*a* and 105*a* are embedded in the support member 101 or the clamp portions 103*b*, 104*b* and 105*b* are press-fittedinholes formed in the support member 101, whereby the terminal portions 103, 104 and 105 are mounted. In this state, the clamp portions 103*b*, 104*b* and 105*b* of the terminal portions 103, 104 and 105 are positioned in the cavities 101*b* of the support member 101.

In this embodiment, and the support shaft 102 and the terminal portion 106 are formed integrally with each other using a metallic plate to reduce the number of parts used and thereby attain the improvement of productivity and reduction of cost.

As shown in FIGS. 11 and 12, three contact members 106, 107 and 108 each formed of a resilient metallic plate are respectively provided with base portions 106*a*, 107*a*, 108*a* and contact portions 106*b*, 107*b*, 108*b*. The contact members 106, 107 and 108 are positioned within the cavities 101*b* of the support member 101 and their base portions 106*a*,107*a* and 108*a* are respectively press-fitted in the U-shaped clamp portions 103*b*, 104*b* and 105*b* of the terminal portions 103, 104 and 105. In this way the contact members 106, 107 and 108 are mounted.

The terminal portions 103, 104, 105 and the contact members 106, 107, 108 are formed using materials different from each other, thereby improving the productivity and making the cost reasonable.

Figure 13:
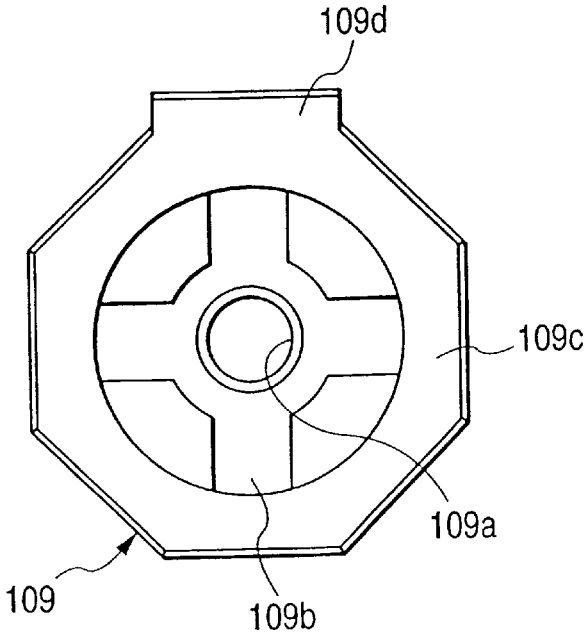
Figure 14:
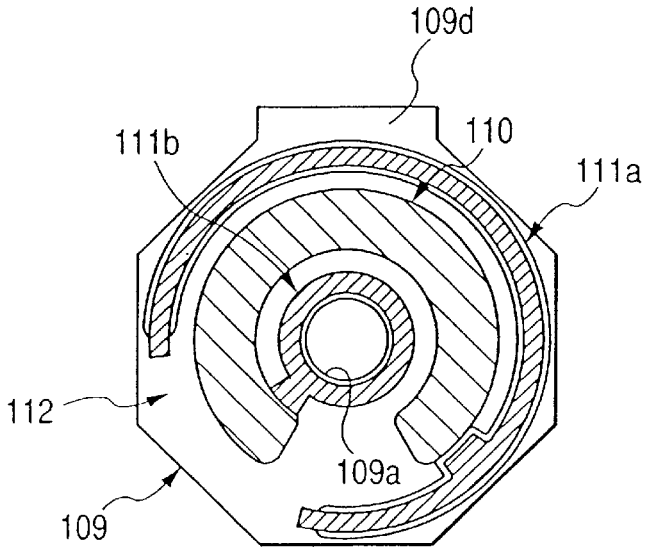
Figure 15:
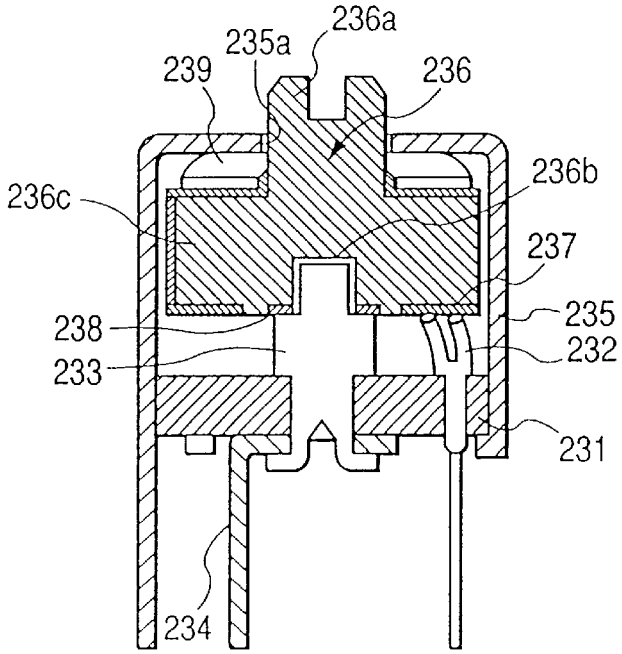
FIG. 15 PRIOR ART
FIG. 15 is a sectional view of a conventional rotary electric component.
Figure 16:
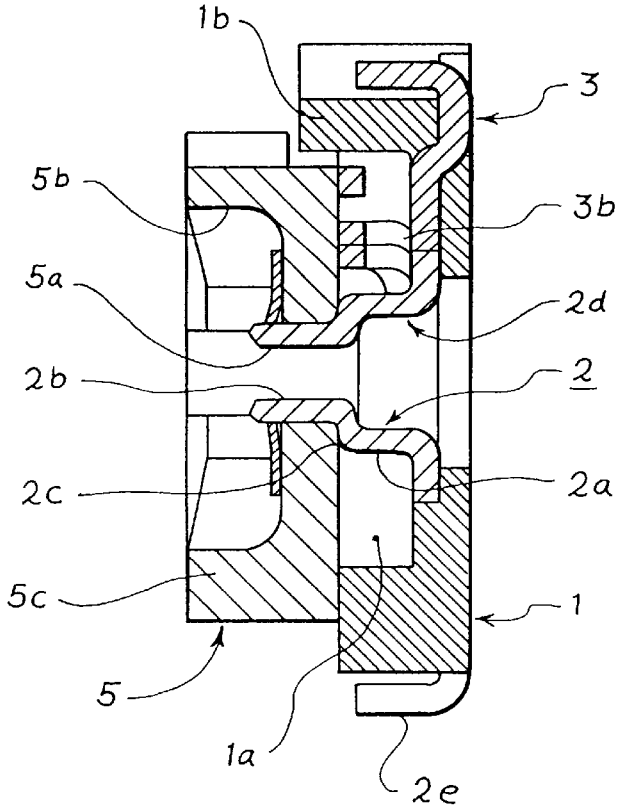
FIG. 16 is a sectional view of the first embodiment including a speed nut.
Figure 17:
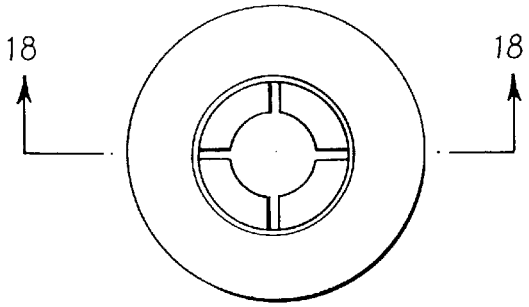
FIG. 17 is an isolated top view of a speed nut.
Figure 18:
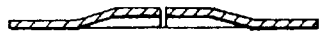
FIG. 18 is an isolated side view of a speed nut.

As shown in FIGS. 13 and 14, a rotor 109, which is formed in an octagonal shape using a ceramic material, has a central through hole 109*a*, a crossed screw-driver groove 109*b* formed in an upper surface of the rotor, a flat surface 109*c* formed as part of the upper surface so as to surround the outer peripheral portion of the crossed screw-driver groove 109*b*, and a stopper portion 109*d* formed at a side position.

On the underside of the rotor 109 is formed an electrically conductive pattern 112 which comprises a resistor 110 and good conductors 111*a* and 111*b*, as shown in FIG. 14. For example, the good conductors 111*a* and 111*b* are formed of silver paste.

The good conductor 111*a* is formed outside the resistor 110, while the good conductor 111*b* is formed inside the resistor 110. The outside good conductor 111*a* is connected to one end of the resistor 110, while the inside good conductor 111*b* is connected to the opposite end of the resistor 110 and is in conduction with both the interior and outer periphery of the through hole 109*a*.

The surface of the rotor 109 with the electrically conductive pattern 112 formed thereon is put on both the outer flat surface 101*c* and extending flat surface 101*d* of the support member 101, then the support shaft 102 is inserted through the through hole 109*a* and its front end portion is caulked. In this way the rotor 109 is mounted rotatably onto the support shaft 102.

Instead of caulking the front end portion of the support shaft 102, a speed nut (not shown) may be press-fitted into the support shaft 102 to mount the rotor 109 onto the support shaft 2.

With the rotor 109 thus mounted, the outer peripheral portion of the rotor is supported by the outer flat surface 101*c*, while the inner peripheral portion thereof is supported by the extending flat surface 101*d* up to near the support shaft 102. Further, the support shaft 102 comes into contact with the portion of the good conductor 111*b* formed within the through hole 109*a*.

Once the rotor 109 is mounted as above, the contact portion 107*b* of the contact member 107 comes into contact with the resistor 110, the contact portion 106*b* of the contact member 106 comes into contact with the outside good conductor 111*a*, and the contact portion 108*b* of the contact member 108 is in contact with the inside good conductor 111*b*.

In this rotary electric component, when a screw-driver is fitted in the screw-driver groove 109*b* of the rotor 109 and is turned to rotate the rotor 109, the inside and outside good conductors 111*b*, 111*a* come into sliding contact with the contact members 108 and 106, respectively, and the resistor 110 comes into sliding contact with the contact member 107, to adjust the resistance value between the terminal portions 103 and 104 and the resistance value between the terminal portions 104 and 105.

Then, the rotation of the rotor 109 stops upon abutment of the stopper portion 109*d* of the rotor 109 against the stopper portion 101*e* of the support member 101.

In this rotary electric component, the rotor 109 is assembled by the steps of sucking the flat surface 109*c* of the rotor 109 by virtue of vacuum (not shown), moving the rotor 109 up to the support member 101, fitting the through hole 109*a* of the rotor 109 onto the support shaft 102 mounted to the support member 101, and then caulking the front end portion of the support shaft 102. The assembly is now completed and thus can be effected automatically.

In the rotary electric component of the present invention, as set forth above, since the rotor 5 (109) with the electrically conductive pattern 8 (112) formed on the underside thereof and having the screw-driver groove 5*d* (109*b*) and also having the through hole 5*a* (109*a*) is mounted rotatably by means of the support shaft 2 (102) which is inserted into the through hole 5*a* (109*a*), the number of parts used is reduced, the size and cost of the rotary electric component are also reduced and the productivity is improved. Besides, since the rotor 5 (109) is mounted to the support shaft 2 (102) by caulking the front end portion of the support shaft 2 (102) to the bottom of the screw-driver groove 5*d* (109*b*) or by attaching a speed nut to the front end portion of the support shaft 2 (102) and bringing it into abutment against the bottom of the screw-driver groove 5*d* (109*b*), there can be attained a reduction in both size and cost and mounting can be done in a simple manner.

If the rotor 5 (109) is formed using a ceramic material, the generation of heat and secular changes are diminished, with little influence on the electrically conductive pattern 8 (112), thus affording a highly accurate electric component. This is effective particularly in a trimmer potentiometer using the resistor 6 (110).

Moreover, by forming the flat surface 5*c* (109*c*) along the outer peripheral portion of the upper surface of the rotor 5 (109), it become possible to automate the assembling work and hence possible to improve the productivity.

Further, since the support member 1 (101) is formed using an insulating material, the support shaft 2 (102) and the contact members 3, 4 (106, 107, 108) are embedded in the support member 1 (101) and are contacted with the good conductor 7 (111*a*, 111*b*) and resistor 6 (110) formed on the rotor 5 (109), there can be provided a rotary electric component as a trimmer potentiometer using a reduced number of parts and superior in productivity.

Further, the support member 101 is provided with a bottom portion for holding the support shaft 102 and also provided with the extending flat surface 101*d* extending to the vicinity of the support shaft 102, the extending flat surface 101*d* being abutted against the underside of the rotor 109, and the contact members 106, 107 and 108 are disposed in the cavities 101*b*. Therefore, the inner peripheral portion of the rotor 109 is supported by the extending flat surface 101*d* up to the vicinity of the support shaft 102, whereby not only the reduction of size can be attained but also the central part of the rotor 109 can be supported firmly. Consequently, it is possible to prevent damage of the rotor 109 during adjustment of the screw-driver groove 109*b*.

Further, since the central warp of the rotor 109 can be diminished, the state of contact between the electrically conductive pattern 112 and the contact member 106 is improved, thus leading to an improvement of accuracy. Particularly, the rotary electric component being considered is extremely superior as a trimmer potentiometer using a resistor.

Additionally, if the outer flat surface 101*c* of the support member 101 is brought into abutment against the rotor 109, the rotor can be supported more firmly.

What is claimed is:

1. A rotary electric component having a groove for adjustment with a screw-driver, said rotary electric component comprising:

a rotor having a screw-driver groove formed in an upper surface thereof and also having a central through hole;

an electrically conductive pattern formed on an underside of said rotor;

a support shaft inserted into said through hole of said rotor for rotatably supporting said rotor; and wherein said support shaft having a large diameter section with a larger diameter than a diameter of said thorough hole of the rotor and a small diameter section fitted to said through hole, said small diameter section being passed through said through hole to support a lower section of a circumferential edge of the through hole of said rotor at a step between said large diameter section and said small diameter section, and said rotor being fixed to said support shaft under a cooperative action by caulking said small diameter section projected from said rotor, a separate support member for fixedly supporting said support shaft or an integral support member with said support shaft, and a slider contact piece supported at said support member and slidingly contacted with said electrically conductive pattern.

2. A rotary electric component according to claim 1, wherein said rotor is formed using a ceramic material.

3. A rotary electric component according to claim 1, wherein a flat surface is formed along an outer peripheral portion of the upper surface of said rotor.

4. A rotary electric component according to claim 1, wherein said support member is formed using an insulating material, the lower end of said support shaft is embedded in said support member, and a base end portion of said slider piece connected to a portion of said slider piece slidably contacting said electrically conductive pattern is embedded in said support member.

5. A rotary electric component having a groove for adjustment with a screw-driver, said rotary electric component comprising:

a rotor having a screw-driver groove formed in an upper surface thereof and also having a central through hole;

an electrically conductive pattern formed on an underside of said rotor;

a support shaft inserted into said through hole of said rotor for rotatably supporting said rotor; and wherein said support shaft having a large diameter section with a larger diameter than a diameter of said through hole of the rotor and a small diameter section fitted to said through hole, said small diameter section being passed through said through hole to support a lower section of a circumferential edge of the through hole of said rotor at a step between said large diameter section and said small diameter section, and said rotor being fixed to said support shaft under a cooperative action by fixing a speed nut to said small diameter section projected from said rotor, a separate support member for fixedly supporting said support shaft or an integral support member with said support shaft, and a slider contact piece supported at said support member and slidingly contacting said electrically conductive pattern.

6. A rotary electric component according to claim 5, wherein said rotor is formed by ceramic material.

7. A rotary electric component according to claim 5, wherein a flat surface is formed at an outer circumference of the upper surface of said rotor.

8. A rotary electric component according to claim 5, wherein said support member is formed by an insulator material, the lower end of said support shaft is embedded in said support member and a base end portion of said slider piece connected to a portion of said slider piece slidably contacting said electrically conductive pattern is embedded in said support member.

9. A rotary electric component having a groove for adjustment with a screw-driver, said rotary electric component comprising:

a rotor having a screw-driver groove formed in an upper surface thereof and also having a central through hole;

an electrically conductive pattern formed on an underside of said rotor;

a support shaft inserted into said through hole of said rotor for rotatably supporting said rotor;

a separate substantial box-like support member of insulating material for fixedly supporting said support shaft or an integral support member with said support shaft having a recess or a hole for passing said support shaft at the central part of the bottom surface and also having a side wall, and wherein there is provided within said support member an extending body extending from a part of said side wall to said recess or the hole and having a flat upper surface capable of being abutted against and supporting the lower surface of said rotor;

a slider contact piece supported at said support member and slidingly contacted with said electrically conductive pattern;

wherein the lower surface of the rotor is abutted against the upper surface of said extending body, said support shaft is passed through said through hole of said rotor and said rotor is rotatably supported against said support member under a cooperative action caulking said support shaft protruded from said rotor.

10. A rotary electric component according to claim 9, wherein said rotor is formed of a ceramic material.

11. A rotary electric component according to claim 9, wherein a flat surface is formed at an outer circumference of the upper surface of said rotor.

12. A rotary electric component according to a claim 9, wherein the lower end of said support shaft is embedded in said support member, and a base end portion of said slider piece connected to a portion of said slider piece slidably contacting said electrically conductive pattern is embedded in said support member.

13. A rotary electric component according to claim 9, wherein the upper end surface of said side wall is formed into a flat surface in flush with a flat upper surface of said extending body and the lower surface of said rotor is abutted against and supported by the flat upper end surface of said side wall and the flat upper surface of said extending body.

14. A rotary electric component having a groove for adjustment with a screw-driver, said rotary electric component comprising:

a rotor having a screw-driver groove formed in an upper surface thereof and also having a central through hole;

an electrically conductive pattern formed on an underside of said rotor;

a support shaft inserted into said through hole of said rotor for rotatably supporting said rotor;

a separate substantial box-like support member of insulating material for fixedly supporting said support shaft or an integral support member with said support shaft having a recess or a hole for passing said support shaft at the central part of the bottom surface and also having a side wall;

an extending body, within said support member, extending from a part of said side wall to said recess or the hole and having a flat upper surface capable of being abutted against and supporting the lower surface of said rotor;

a slider contact piece supported at said support member and slidingly contacted with said electrically conductive pattern; and wherein the lower surface of the rotor is abutted against the upper surface of said extending body, said support shaft is passed through said through hole of said rotor and said rotor is rotatably supported against said support member under a cooperative action by fixing a speed not to said support shaft protruded from said rotor.

15. A rotary electric component according to claim 14, wherein said rotor is formed of a ceramic material.

16. A rotary electric component according to claim 14, wherein a flat surface is formed at an outer circumference of the upper surface of said rotor.

17. A rotary electric component according to a claim 14, wherein said support member is formed using an insulating material, the lower end of said support shaft is embedded in said support member, and a base end portion of said slider piece connected to a portion of said slider piece slidably contacting said electrically conductive pattern is embedded in said support member.

18. A rotary electric component according to a claim 14, wherein the upper end surface of said side wall is formed into a clat surface in flush with a flat upper surface of said extending body and the lower surface of said rotor is abutted against and supported by the flat upper end surface of said side wall and the flat upper surface of said extending body.

* * * * *